US007704449B2

(12) United States Patent
Kikuchi et al.

(10) Patent No.: US 7,704,449 B2
(45) Date of Patent: Apr. 27, 2010

(54) ELECTRODE, ELECTRICAL CONTACT AND METHOD OF MANUFACTURING THE SAME

(75) Inventors: Shigeru Kikuchi, Hitachi (JP); Masato Kobayashi, Hitachi (JP); Kenji Tsuchiya, Hitachi (JP); Noboru Baba, Hitachiota (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 12/213,818

(22) Filed: Jun. 25, 2008

(65) Prior Publication Data

US 2008/0274003 A1 Nov. 6, 2008

Related U.S. Application Data

(62) Division of application No. 11/206,771, filed on Aug. 19, 2005, now abandoned.

(30) Foreign Application Priority Data

Nov. 15, 2004 (JP) ..... 2004-329937

(51) Int. Cl.
*B22F 3/12* (2006.01)

(52) U.S. Cl. ..... 419/38; 419/23; 419/39

(58) Field of Classification Search ..... 419/23, 419/38, 39

See application file for complete search history.

(56) References Cited

U.S. PATENT DOCUMENTS

| | | | | |
|---|---|---|---|---|
| 1,932,678 | A | 10/1933 | Ruben | 75/245 |
| 2,620,555 | A | 12/1952 | William | 75/245 |
| 3,069,757 | A | 12/1962 | Beggs et al. | 428/547 |
| 3,610,859 | A | 10/1971 | Schreiner et al. | 200/264 |
| 3,985,512 | A | 10/1976 | Hassler et al. | 428/545 |
| 4,190,753 | A | 2/1980 | Gainer et al. | 218/130 |
| 4,537,743 | A | 8/1985 | Yamanaka et al. | 419/38 |
| 4,836,978 | A | 6/1989 | Watanabe et al. | 419/10 |
| 5,352,404 | A | 10/1994 | Yoshioka et al. | 419/31 |
| 5,354,352 | A | 10/1994 | Seki et al. | 75/245 |
| 5,403,543 | A | 4/1995 | Okutomi et al. | 419/23 |
| 6,765,167 | B2 | 7/2004 | Kikuchi et al. | |
| 2005/0092714 | A1 * | 5/2005 | Kikuchi et al. | 218/130 |

FOREIGN PATENT DOCUMENTS

| | | | |
|---|---|---|---|
| EP | 1249848 | | 10/2002 |
| JP | 10-012103 | | 1/1998 |
| JP | 2003-147407 | * | 5/2003 |
| JP | 2003-223834 | | 8/2003 |
| JP | 2005-135778 | | 5/2005 |

* cited by examiner

*Primary Examiner*—Roy King
*Assistant Examiner*—Ngoclan T Mai
(74) *Attorney, Agent, or Firm*—Brundidge & Stanger, P.C.

(57) ABSTRACT

An electrical contact comprising a matrix of an alloy of a high electro-conductive metal and a low melting point metal and particles of a refractory metal dispersed in the matrix. The electrical contact comprises the alloy containing a low melting point metal of at least one of Sn, Te and Be, and the refractory metal is Cr. The alloy comprising the low melting point metal in an amount of 0.5 to 3% by weight and the balance being Cu.

7 Claims, 4 Drawing Sheets

ELECTRODE, ELECTRICAL CONTACT AND METHOD OF MANUFACTURING THE SAME

CLAIM OF PRIORITY

This application is a divisional application to U.S. patent application Ser. No. 11/206,771, filed Aug. 19, 2005, now abandoned, which claims priority from Japanese application Serial No. 2004-329937, filed on Nov. 15, 2004, the contents of which are hereby incorporated into this application.

FIELD OF THE INVENTION

The present invention relates to an electrical contact for use in a vacuum circuit breaker, a vacuum switch, etc, an electrode for the switches and a method of manufacturing the same.

RELATED ART

Downsizing of power transmission-distribution equipments such as vacuum circuit breakers, etc has been desired. In order to meet the demand, an operation force for the vacuum circuit breaker must be made small by suppressing welding of the contacts in the vacuum valve so that the operator for the vacuum circuit breaker can be downsized. As a means for attaining the suppression of welding, low melting point metals are added to a material for the electrical contacts thereby to make the electrode material brittle so that the welded contacts are easily separated by a small force as disclosed in patent document No. 1.

(Patent Document No. 1) Japanese Patent Laid-Open No. 10-12103

In a method of adding directly the low melting point metals to the electrical contact material, the low melting point metals are present by themselves in the electrical contact material. Accordingly, the low melting point metals vaporize by joule heat at the time of current flow or current interruption thereby to lower the vacuum degree, resulting in lowering the withstanding voltage performance and current breaking performance.

Further, the electrical contacts are manufactured by sintering methods or melting infiltration methods; the low melting point metals vaporize in the heating step of the manufacture thereby to contaminate production plants or to give adverse affects on the environment.

SUMMARY OF THE INVENTION

Thus, it has been desired to provide an electrical contact with no lowering of electrode performance due to evaporation of the low melting point metals and with excellent bonding-proof (anti-welding) performance; the electrical contacts should be separated with a small separation force even when the contacts are bonded.

BRIEF DESCRIPTION OF THE DRAWINGS

FIG. 1(*a*) is a plan view of the contact and FIG. 1(*b*) is a cross sectional view of the contact.

FIG. 2(*a*) is a structure of a sintered alloy, and FIG. 2(*b*) is a structure of infiltration alloy or of a molten-solidification alloy.

DETAILED DESCRIPTION OF THE PREFERRED EMBODIMENTS

Explanation of Reference Numerals

1; electrical contact, 1*a*; fixed side electrical contact, 1*b*; movable side electrical contact, 2; spiral slits, 3, 3*a*, 3*b*; reinforcing plate, 4, 4*a*, 4*b*; electrode rod, 5; brazing material, 6*a*; fixed electrode, 6*b*; movable electrode, 7; shield for electrical contacts, 8; shield at the movable electrode rod side, 9*a*; end plate at the fixed electrode side, 9*b*; end plate at the movable electrode side, 10; bellows, 11; guide for the movable electrode rod, 12; holder at the movable electrode rode, 13; insulating cylinder, 14; vacuum valve, 15; epoxy resin cylinder, 16; insulating operation rod, 17; upper terminal, 18; collector, 19; lower terminal, 20; contact spring, 21; supporting lever, 22; prop, 23; plunger, 24; knocking rod, 25; roller, 26; main lever, 27; tripping coil, 28; tripping lever, 29; reset spring, 30; closing coil, 31; evacuation port, 32; outer vacuum container, 33; upper plate member for the vacuum container 32, 34; lower plate member for the vacuum container 32, 35; side plate for the vacuum container 32, 36; upper through-hole, 37; upper base plate, 38; outer bellows, 39; lower through-hole, 40; insulating bushing, 41; lower base plate, 42; flexible conductor for connecting the adjoining movable electrode rodes, 43; through-holes for the flexible conductors, 51; central hole.

The high electro-conductive metal is copper, the low melting point metal is at least one of Sn, Te and Bi, and the refractory metal is chromium. The alloy comprises the low melting point metals in an amount of 0.5 to 3% by weight and the high electro-conductive metal being the balance.

Figure 1A:
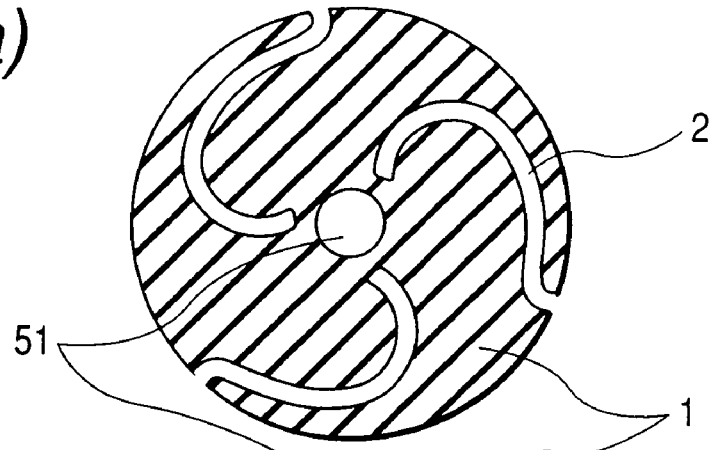
FIGS. 1(*a*) and 1(*b*) show the structures of the electrical contact of the present invention.
Figure 1B:
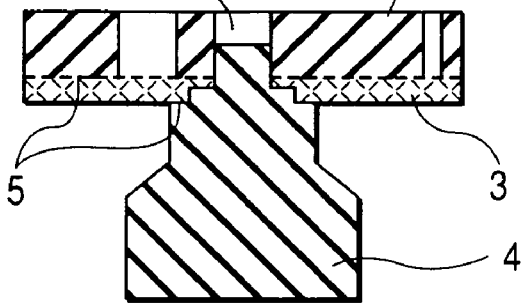

The electrode of the present invention has a disc shape; the disc has a center-through hole formed in the center thereof and a plurality of though-slits formed from the center towards the circumference, the slits being separately formed. The disc has a plurality of segments of a wing shape, segments being separated by the slits as shown in FIG. 1(*a*).

A method of manufacturing an electrical contact of the present invention comprises: mixing powder of an alloy of a high electro-conductive metal and a low melting point metal and powder of a refractory metal, press-molding the powder mixture and sintering the shaped powder mixture. In particular, the alloy powder should have a particle size of 104 μm or less and the refractory metal powder should have a particle size of 75 μm or less.

Further, a pressure for the press-molding of the powder mixture should be 120 to 500 Mpa, and the sintering should be conducted in vacuum or in an inert gas atmosphere at a temperature lower than the melting points of the low melting point metal and the high electro-conductive metal. If the molding pressure is lower than 120 Mpa, handling of the molded mixture is difficult; if the molding pressure is higher than 500 MPa, the powder tends to stick to a metal mold, thereby to lower the productivity.

When the molded powder mixture is sintered at the temperature lower than the melting points of the high electro-conductive metal and the low melting point metals in vacuum or in inert gas atmosphere, it is possible to sinter the molded powder mixture with an ultimate shape, i.e. a near-net shape sintering. Sintering methods make it possible to produce an ultimate product having a near net shape, without post-shaping or machining so that the electrical contact is produced at a low cost.

Figure 2A:
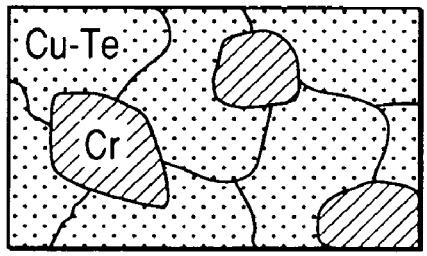
FIGS. 2(*a*) and 2(*b*) show metallurgical structures.
Figure 2B:
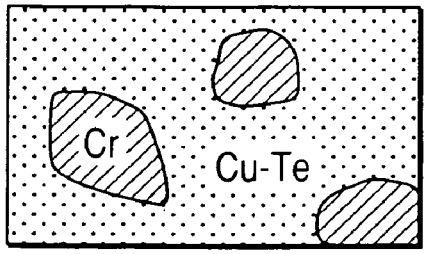

The electrical contact can be manufactured by an infiltration method wherein the molten alloy of the low melting point metal and the high electro-conductive metal is impregnated into the pressure-molded skeleton or a porous sintered body of the refractory metal of the pressure-molded powder comprising the alloy powder and the refractory metal powder or the refractory metal powder alone. According to this method, it is possible to produce electrical contacts being free from voids, thereby to stabilize current breaking performance. The electrical contact of the present invention can be manufactured by solidifying molten alloy comprising the low melting point metal, high electro-conductive metal and the refractory metal to produce a dense, void-free electrical contacts. The metallurgical structure is shown in FIG. 2(*b*).

The alloy of the low melting point metals and the high electro-conductive metal can be prepared by an atomizing method, for example. When the particles of the powders within the above-mentioned ranges are 95% or more, homogeneous electrical contacts are obtained.

The electrical contact has a disc shape, which has a center through-hole at the center. A plurality of though-slits extending from the center hole towards the circumference of the disc shape contact is formed. The slits are separated as shown in FIG. 1(*a*), thereby to prevent generation of arc at the center of the contact and to drive the arc outwardly, so that the current breaking failure by retention of the arc is avoided.

The disc-shape electrical contact of the present invention is electrically connected with an electrode rod at its rear face opposite to the front face where the arc generates. Each of the assemblies comprising the electrical contact and the electrode rod constitutes a fixed electrode or a movable electrode.

The vacuum valve according to the present invention comprises a vacuum container, and a pair of the fixed electrode and the movable electrode accommodated in the vacuum container, wherein at least one of the fixed electrode and the movable electrode employs the electrical contact.

The vacuum circuit breaker according to the present invention comprises the vacuum valve mentioned above, conductor terminals electrically connected to the fixed electrode and movable electrode in the vacuum container and extended outside of the vacuum container, and the operator for driving the movable electrode. According to the present invention, it is possible to obtain vacuum circuit breakers or the like with excellent electrode performance and bonding-proof performance.

In the following, embodiments of the present invention are described; the scope of the present invention will not be limited to the following specific examples.

Embodiment 1

An electrical contact was prepared from an alloy material wherein Cr powder of the refractory metal is dispersed in the matrix of the alloy of the low melting metal and Cu of the high electro-conductive metal. FIG. 1 (*a*) shows a plan contour of the electrical contact 1; 2 denotes spiral slits for driving arc to prevent retention on the face of the contact, 3 a reinforcing plate made of stainless steel, 4 denotes an electrode rod, 5 a brazing material for bonding the contact to the reinforcing plate 3, 51 the center hole for preventing the arc at the center of the contact.

A method of manufacturing the electrical contact in this embodiment is as follows.

At first, powder of an alloy of Cu—Te having a particle size of 104 μm, which was prepared by an atomizing method and powder of Cr having a particle size of 75 μm were mixed with a V-mixer so as to obtain the composition of the electrical contacts shown in Table 1. In this embodiment, almost all of the powders had the particle size within the range mentioned-above. The Cr powder contained 680 ppm of oxygen, 700 ppm of aluminum and 800 ppm of silicon.

Then, the powder mixture was filled in a metal mold having a shape of the electrical contact, which has the spiral slits 2 and the central hole 51. The powder mixture was pressure-molded with a hydraulic press under a pressure of 400 MPa. The molded product had an appearance density or relative density (actual density/theoretical density×100) of about 71%. The molded product was sintered in vacuum at 1050° C.×2 hours to produce the electrical contact 1. The melting point of the alloy used in the embodiment was about 1060 to 1080° C. Although the melting points of the alloys vary depending on the compositions, desired electrical contacts could be produced at temperatures lower than the melting points of the alloys. The relative density was about 95%. The metallurgical structure is shown in FIG. 2(*b*).

A method of manufacturing the electrode rod was as follows. An electrode rod 4 was made of oxygen-free copper and the reinforcing plate 3 was made of SUS 304 by machining in advance. A projection portion of the electrode rod 4 was inserted into the central holes of the reinforcing plate 3 and of the sintered electrical contact 1 by means of a brazing material 5. The brazing material 5 was sandwiched between the electrical contact 1 and the reinforcing plate 3. The assembly was heated in vacuum at 970° C.×10 min. to obtain the electrode rod shown in FIG. 1. This electrode rod was one for a vacuum valve with a rated voltage of 7.2 kV, a rated current of 600 A and a rated interruption current of 20 kA. If the mechanical strength of the electrical contact is sufficiently high, the reinforcing plate may be omitted.

In addition to the above-mentioned process for manufacturing the electrical contact, the electrical contact cam be manufactured by mixing powder of Cu—Te alloy and powder of Cr, pressure-molding the powder mixture, and impregnating the molten Cu—Te alloy into the pressure molded powder mixture of the Cu—Te and Cr powders by heating in vacuum at about 1100° C. for two hours. Further, the electrical contact is prepared by melting a desired composition of Cu, Te and Cr at a temperature higher than the melting point of copper but lower than the melting point of chromium, followed by solidification of the melted composition.

Furthermore, when the low melting point metal is Sn or Bi, the metals can be alloyed with Cu at relatively low temperatures to produce the electrical contact 1.

Embodiment 2

A vacuum valve was assembled using the electrical contact prepared in the embodiment 1. The specification of the vacuum valve is: a rated voltage=7.2 kV, a rated current=600 A, and a rated interruption current=20 kA.

Figure 3:
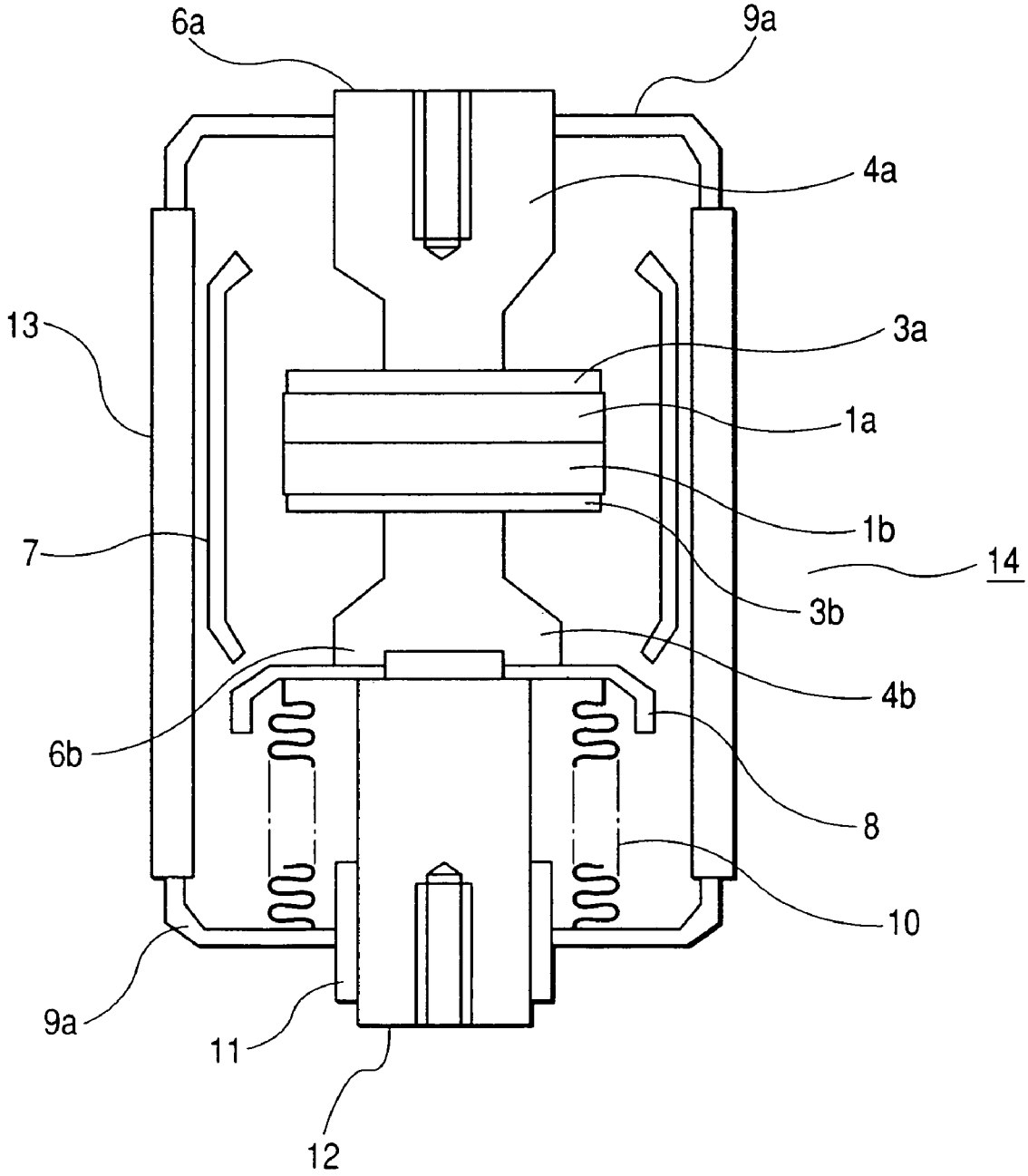
FIG. 3 is across sectional view of a vacuum valve used in a circuit breaker to which the present invention is applied.

FIG. 3 shows a structure of a vacuum valve in this embodiment. In FIG. 3, 1*a*, 1*b* respectively denote the electrode rod of the fixed side and the electrode rod of the movable side, so that the fixed electrode rod 6*a* and the movable electrode rod 6*b* are constituted. The movable electrode rod 6*b* is bonded by brazing to the movable holder 12 by means of the movable shield 8 for preventing scattering of metal vapor, etc at the time of circuit breaking. These members are gas-tightly sealed with the fixed side end plate 9*a*, movable end plate 9*b* and the insulating cylinder 13. The fixed side electrode rod 6*a* and the movable side electrode rod 6*b* are connected to the outer conductors by the screws of the movable side holder 12.

The shield 7 is disposed in the inner side of the insulating cylinder 13 to surround the electrical contacts 1*a*, 1*b*. The shield 7 prevents scattering of metal vapor in the inner vacuum container at the time of current interruption. The guide 11 for supporting the sliding portions is disposed between the movable side end plate 9*b* and the fixed side holder 12. The bellows 10 for moving the movable holder 12 up and down, keeping vacuum in the vacuum valve, is disposed between the movable side shield 8 and the movable side end plate 9*b*, thereby to switch the movable electrode rod 6*b* and the fixed electrode rod 6*a*.

Using the electrical contacts 1*a*, 1*b* prepared in the embodiment 1 shown in FIGS. 1(*a*) and 1(*b*), the vacuum valve of the present invention was assembled.

Embodiment 3

Figure 4:
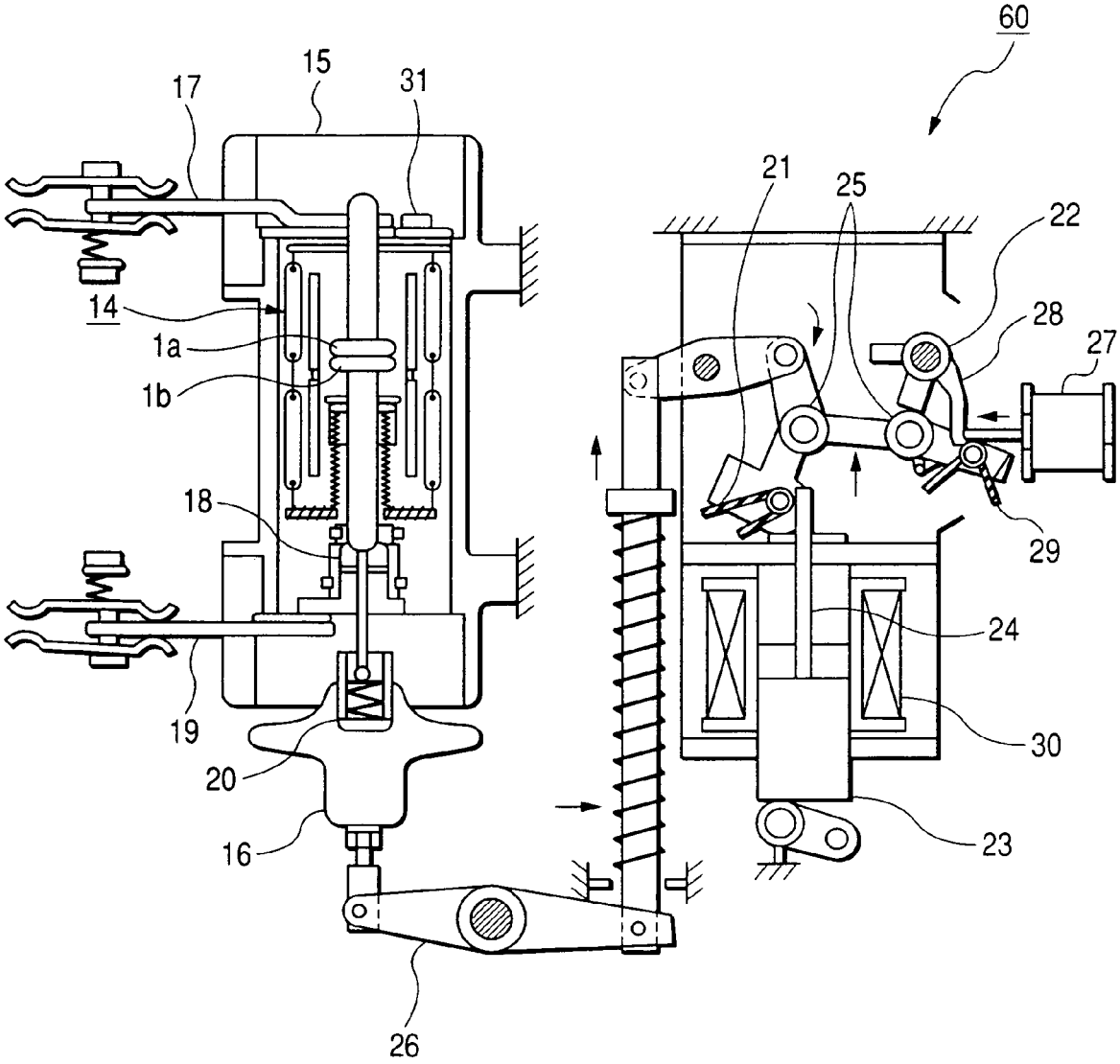
FIG. 4 is a diagrammatic view of a vacuum circuit breaker to which the present invention is applied.

A vacuum circuit breaker that employed the vacuum valve assembled in Embodiment 2 was prepared. FIG. 4 shows a diagrammatic view of a vacuum circuit breaker comprising a vacuum valve 14 and an operator 60. The vacuum circuit breaker has the operator disposed at the front side of the vacuum valve and three phase assembled epoxy cylinders 15 for supporting the vacuum valve 14 at the rear side. The vacuum valve 14 is operated with the operator by means of the insulating rod 16.

When the circuit breaker is in a closed state, current flows through the upper terminal 17, the electrical contact 1, the collector 18 and the lower terminal 19. A contact force between the electrode rods is maintained by the supporting spring 20 disposed to the insulating rod 16. The contact force between the electrode rods and magnetic motive force are maintained by the supporting lever 21 and the prop 22. When the closing coil 30 is energized, the plunger 23 pushes up the roller 25 by means of the knocking rod 24 from the open state to rotate the main lever 26 thereby to close the electrode rods, and then the closed state is maintained by the supporting lever 21.

If the circuit breaker is in a free state for tripping, the trip coil 27 is energized to trip the prop 22 by the trip lever 28 thereby to rotate the main lever 26 to open the electrode rods.

If the circuit breaker is in an open state after the electrode rods are opened, the link returns to the original position by the reset spring 29 thereby to engage the prop 22. When the closing coil 30 is energized in this state, the circuit breaker becomes open. 31 denotes an evacuation port for evacuating the vacuum container. The outer vacuum container and the inner vacuum container for the vacuum valves are separately from each other.

Embodiment 4

Current breaking tests were conducted wherein the electrical contacts prepared in Embodiment 1 were installed in the vacuum circuit breaker shown in Embodiment 3, the vacuum circuit breaker having a rated voltage of 7.2 kV, a rated current of 600 A and a rated breaking current of 20 kA, respectively. Table 1 shows the compositions of the electrical contacts and the results of current breaking tests. Nos. 1 to 5 are the electrical contacts of the present invention and Nos. 6 to 12 are comparative contacts. In Nos. 10 to 12, Cu and Te could not be alloyed; Cu and Te were added as elements.

Interruption performances are compared with those of No. 2. In the range of Cr of 15 to 40% by weight (Nos. 1 to 3), the smaller the amount of Cr, the lower the withstanding voltage performance becomes; on the other hand, the larger the amount of Cr, the lower the interruption performance becomes. However, these characteristics are acceptable to the practical use. When the amount of Te is from 0.5 to 3% by weight (Nos. 1 to 5), excellent bonding-proof property and a small separation force are obtained.

The evaluations of the various performances are made based on the JIS; that is, the evaluation is made whether the circuit breaker can interrupt a current of 28 kA or not. The interruption performance of the No. 2 was 32 kA; if the relative value is 0.9, the interruption performance is 28.9 kA, which is acceptable; but if the relative value is 0.8, the interruption performance is 25.6 kA, which is not acceptable. Similarly, since the withstanding voltage in accordance with the JIS is 66 kV, if the relative value of the withstanding with respect to the No. 2 contact having a withstanding voltage of 73 kV is 0.9, the actual withstanding voltage is 66 kV, which is acceptable, but if the relative value is 0.8, the actual withstanding voltage is 58 kV, which is not acceptable.

When an amount of Te is 0.5% by weight (No. 4), the bonding-proof performance is lower than that of the standard sample (No. 2), and the separation force increases; the values are acceptable ones, however. Although the separation force increases when the amount of Cr is 15% by weight (No. 1), the value is within an acceptable range.

On the other hand, when the amount of Cr is less than 15% by weight (No. 6), decrease in withstanding voltage is particularly remarkable and the separation force increases. When the amount of Cr is larger than 40% by weight (No. 7), current breaking performance lowers, and there may be a fear that current breaking failure may take place. Further, the amount of Te in the Cu—Te alloys is less than 0.5% by weight (No. 8), the current breaking performance remarkably decreases and the separation force increases. When the amount of the Te in the Cu—Te alloy is larger than 3% by weight (No. 9), the current breaking performance and withstanding voltage performance become remarkably worse.

In the cases of Te as a single element addition (Nos. 10 to 12), the bonding-proof performance becomes better and the separation force decreases, but as the amount of Te increases, the current breaking performance and withstanding voltage performance become worse.

From the above discussions, it is apparent that the electrical contacts of the preset invention exhibit excellent bonding-proof performance and low separation force and do not exhibit decrease in current breaking performance and withstanding voltage performance, which are observed in the addition of Te as the single element.

The improvement in the withstanding voltage performance of the electrical contacts of the present invention depends on that the low melting point metals decomposed by arc heat at the time of current interruption soak out from the contacts. This phenomenon is observed not only in the Te-containing ally, but also in the Bi- or Sn-containing alloys, since Sn and Bi have melting points lower than 300° C.

| | No. | Composition of contact (wt %) Cr | Cu—Te | Te in Cu—Te alloy | Current breaking tests: Breaking performance | Withstanding voltage | Bonding-proof | Spearation force | Memo |
|---|---|---|---|---|---|---|---|---|---|
| Invention | 1 | 15 | 85 | 1.5 | 1.2 | 0.9 | 1 | 1.1 | |
| | 2 | 25 | 75 | 1.5 | 1 | 1 | 1 | 1 | Standard sample |
| | 3 | 40 | 60 | 1.5 | 0.9 | 1.3 | 1.1 | 0.9 | |
| | 4 | 25 | 75 | 0.5 | 1 | 1 | 0.9 | 1.1 | |
| | 5 | 25 | 75 | 3 | 1 | 0.9 | 1.2 | 0/8 | |
| Comp. ex. | 6 | 10 | 90 | 1.5 | 1.2 | 0.7 | 0.9 | 1.2 | |
| | 7 | 45 | 55 | 1.5 | 0.8 | 1.4 | 1.1 | 0.9 | |
| | 8 | 25 | 75 | 0.3 | 1 | 1.1 | 0.8 | 1.3 | |
| | 9 | 25 | 75 | 3.5 | 0.9 | 0.8 | 1.3 | 0.8 | |

| | No. | Composition of contact (wt %) Cr | Cu | Te | Current breaking tests: Breaking performance | Withstanding voltage | Bonding-proof | Separation force | Memo |
|---|---|---|---|---|---|---|---|---|---|
| Comp. ex. | 10 | 25 | 74.5 | 0.5 | 0.9 | 0.8 | 1 | 0.9 | Te added as single element |
| | 11 | 25 | 73.5 | 1.5 | 0.8 | 0.7 | 1.2 | 0.7 | |
| | 12 | 25 | 72 | 3 | 0.7 | 0.6 | 1.3 | 0.6 | |

Embodiment 5

Figure 5:
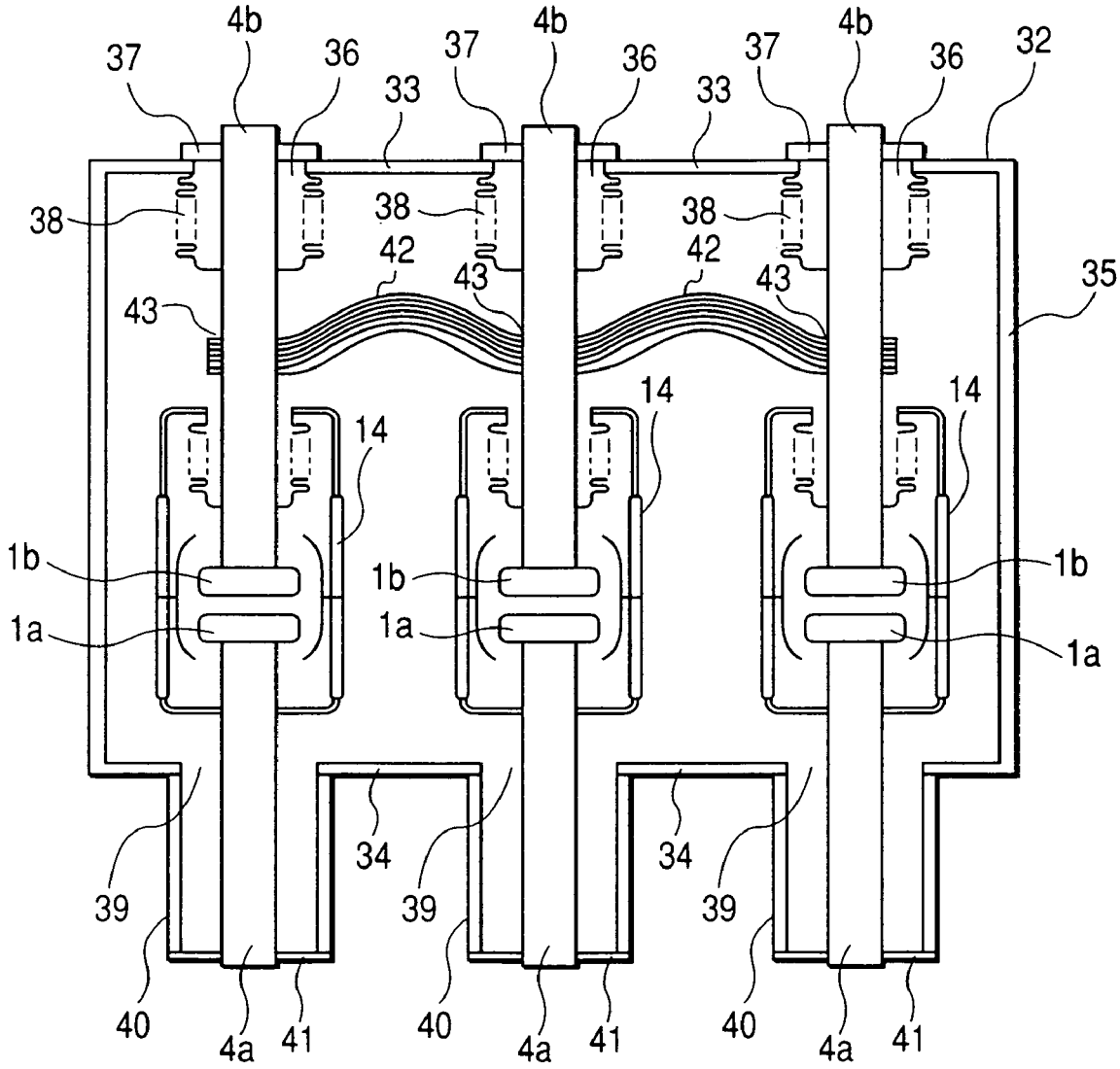
FIG. 5 is a cross sectional view of a load-breaking switch for a transformer installed at road sides.

The vacuum valve prepared in Embodiment 2 was installed in the vacuum switch other than the vacuum circuit breaker. FIG. 5 shows the load breaking switch for the road side transformer. The vacuum valves 14 were installed in the switch. In this switch, a plurality of pairs of vacuum valves 14 corresponding to main switches are disposed in the outer vacuum container 32, which is constituted by the upper plate 33, the lower plate 34 and side plates 35 at the both sides. The peripheries of the plate members are bonded by welding to constitute the outer vacuum container 32.

The upper plate 33 is provided with upper holes 36. Circular insulating upper bases 37 are disposed to the respective upper holes 36. In the cylindrical hollows formed in the upper bases 37, movable electrode rods 4*b* are inserted in a manner being capable of up and down movement in the hollows. The upper holes 36 are gas-tightly sealed by the upper bases 37 and the movable side electrode rods 4*b*.

The upper ends of the movable electrode rods 4*b* are connected to an electro-magnetic operator (not shown) disposed outside the outer vacuum container 32. The lower side of the upper end plate 33 is provided with outer bellows 38 at the respective edges of the holes 36, which move up and down. The bellows 38 are fixed at their ends to the respective movable electrode rods 4*b* and, at their other ends, the bellows 38 are fixed to lower ends of the upper end plate 33. In order to establish a gas-tight structure of the outer vacuum container 32, the outer bellows 38 are disposed along the axes of the movable electrode rods 4*b*, the one ends of the bellows being fixed to the holes 36 and the other ends of the bellows being fixed to the electrode rods 4*b*. An evacuation port (not shown) is disposed to the upper end plate of the outer vacuum container 32 to evacuate the outer vacuum container 32.

On the other hand, the lower end plate 34 is provided with through-holes 39; insulating bushings 40 are fixed to the respective edges of the through-holes 39 so as to cover them. The fixed electrode rods 4*a* are inserted into the cylindrical hollows in the centers of the respective lower bases 41. Therefore, the through-holes formed in the lower end plate 34 are sealed by the insulating bushings 40, the lower bases 41 and the fixed electrode rods 4*a*. The one ends of the fixed electrode rods 4*a* are connected to cables (not shown) disposed outside the outer vacuum container 32.

The vacuum valves 14 corresponding to the main circuit switches of the load breaking switch are disposed in the outer vacuum container 32. The movable electrode rods 4*b* are connected to each other by means of the flexible conductor 42. The flexible conductor 42 having two curved portions in the axial direction of the electrode rods is a laminate of copper plates and stainless steel plates, the plates being alternately laminated. The flexible conductor 42 has through-holes 43 through which the electrode rods 4*b* are inserted to connect them.

As having been described, the vacuum valves of the embodiment of the present invention are suitable for the load breaking switch of the load side transformers; the vacuum valves may be applied to other switches such as vacuum insulated switchgears.

What is claimed:

1. A method of manufacturing an electrical contact, comprising:

mixing a powder of an alloy of at least one of tellurium (Te) and bismuth (Bi), with copper (Cu) and a powder of chromium (Cr);

pressure-molding the powder mixture; and sintering the molding.

2. The method of manufacturing the electrical contact according to claim 1, wherein 95% or more of the powder of the alloy has a particle size of 104 μm or less, and 95% of the Cr powder has a particle size of 75 μm or less.

3. The method of manufacturing the electrical contact according to claim 1, wherein a pressure for the pressure-molding is 120 to 500 MPa.

4. The method of manufacturing the electrical contact according to claim 1, wherein the sintering is conducted at a temperature lower than the melting point of alloy in an atmosphere of vacuum or an inert gas.

5. The method of manufacturing the electrical contact according to claim 1, wherein an amount of Te and Bi is 0.5 to 3% by weight.

6. The method of manufacturing the electrical contact according to claim 1, wherein an amount of Te is 0.5 to 3% by weight.

7. The method of manufacturing the electrical contact according to claim 1, wherein an amount of Bi is 0.5 to 3% by weight.

* * * * *